United States Patent [19]

Kelly et al.

[11] 4,398,966

[45] Aug. 16, 1983

[54] CORROSION OF TYPE 304 STAINLESS STEEL BY LASER SURFACE TREATMENT

[75] Inventors: Thomas J. Kelly, Suffern; Joseph L. Nelson, Warwick, both of N.Y.

[73] Assignee: Huntington Alloys, Inc., Huntington, W. Va.

[21] Appl. No.: 372,648

[22] Filed: Apr. 28, 1982

[51] Int. Cl.[3] ..... C21D 6/00

[52] U.S. Cl. ..... 148/4; 148/135

[58] Field of Search ..... 148/4, 13, 14, 135, 148/145, 39

[56] References Cited

U.S. PATENT DOCUMENTS

| | | | |
|---|---|---|---|
| 2,172,428 | 7/1982 | Wulff et al. | 148/4 |
| 3,848,104 | 7/1982 | Locke | 148/39 |
| 3,850,698 | 7/1982 | Mallozz et al. | 148/4 |
| 4,000,011 | 7/1982 | Sato et al. | 148/13 |
| 4,122,240 | 7/1982 | Banas et al. | 148/13 |
| 4,151,014 | 7/1982 | Charschan | 148/13 |

*Primary Examiner*—L. Dewayne Rutledge
*Assistant Examiner*—Debbie Yee
*Attorney, Agent, or Firm*—Raymond J. Kenny; Francis J. Mulligan, Jr.

[57] ABSTRACT

Surface treatment of stainless steel with pulsed beam from laser benefits resistance to corrosion in acid chloride media.

10 Claims, 2 Drawing Figures

CORROSION OF TYPE 304 STAINLESS STEEL BY LASER SURFACE TREATMENT

The present invention relates to metallurgy and more particularly to surface treatment of metals.

It is well known that many stainless steels are, at times, characterized by good resistance to corrosive tendencies of acids and other media, but, at other times, in other phases of thermomechanical history, the same steel compositions are susceptible to undesirable corrosive attack, such as metal loss, pitting or cracking. Inasmuch as corrosive attack frequently comes from the outside of a metal article, great benefit is achievable by rendering the exterior surface resistant to corrosion even if the interior is unchanged. Moreover, often it is desirable to retain the interior metal characteristics or, at least, to avoid unnecessary loss of time and labor cost and use of facilities by specially treating the entire article. Thus there are needs for surface treatments to provide improved resistance against corrosion on surfaces of metal articles. One of the widely used stainless steels that has been vulnerable to corrosion when in some, one or more, phases, is known as Type 304, nominally containing about 18% chromium, 9% nickel and the balance iron. Surface corrosion difficulties therewith have included metal loss, pitting and stress corrosion cracking. Many metallurgical studies have recognized that there are corrosion problems with Type 304 stainless steel and have pointed at possible causes, e.g. chromium carbide precipitates and manganese sulfide inclusions, and proposed solutions, such as annealing, protective coating, flame treatment and laser treatment. Yet, there still remain needs for economically practical methods for surface treatment of stainless steel to enhance the resistance against corrosion.

There has now been discovered a new surface treatment for improving corrosion resistance of metals, particularly including stress corrosion cracking resistance of 304 stainless steel.

An object of the invention is to provide a new process for improving the corrosion resistant characteristics of a stainless steel surface.

Figure 1:
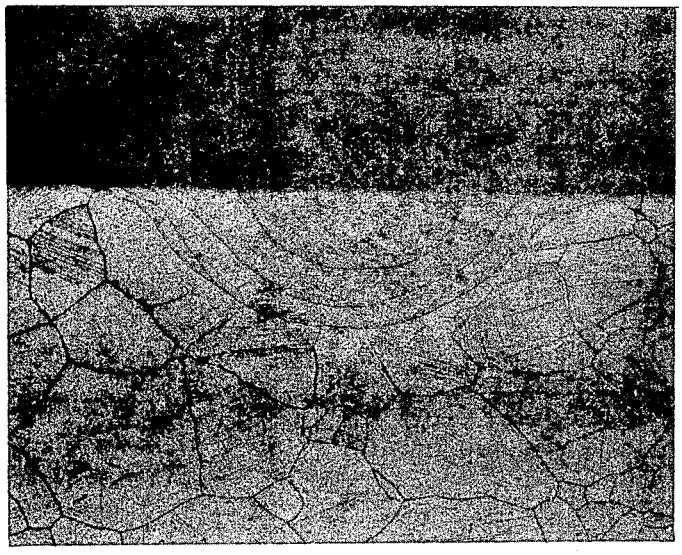

Other objects and advantages of the invention will be apparent from the following description and drawing wherein:

FIG. 1 is a reproduction of a photomicrograph, taken at 100X magnification, of a cross-section, etched with a 10% oxalic acid solution, of a single laser bead on a Type 304 stainless steel specimen;

and

Figure 2:
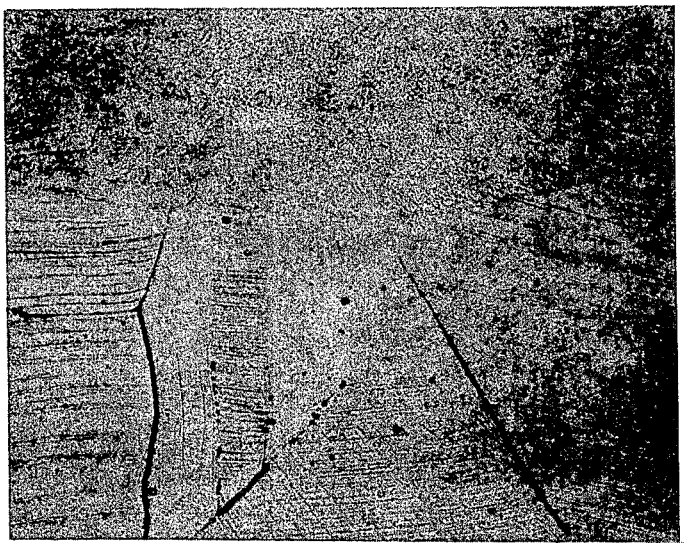

FIG. 2 is a reproduction of a photomicrograph, taken at 500X magnification, of a portion of the same etched section referred to by FIG. 1.

The present invention contemplates a metal treatment process wherein a pre-selected localized area of a metal surface on a stainless steel article or other body is rapidly heated to the solid solution temperature, or higher, advantageously to the molten state, and then cooled back down below the solid solution temperature, often down to room temperature, at a rapid cooling rate, the quench rate, in the range of $1\times10^3$ °C./sec to $1\times10^8$ °C./sec, advantageously, at least about $1\times10^5$ or $1\times10^6$ °C./sec, e.g., a quench rate of $1.6\times10^6$ °C./sec is cooling down from 1620° C. to 20° C. is 1 millisecond. The localized heat is applied to a pulsed energy metal surface by the beam such as that of a pulsed laser operating at a power of at least 50 W (watts), advantageously 250 W to 350 W. Wavelength of the beam is generally 0.5 to 11 μm (micrometers), advantageously 1.06 μm. Pulse rate is generally about 100 to 200 pps (pulse per second). Depth of melting is advantageously about 0.5 mm, or 0.64 mm to 0.38 mm and possibly may be 1.27 mm, or lesser depths, or as little as zero inasmuch as the laser heating benefit may extend into the metal even without melting.

For most purposes of enhancing the corrosion resistance of an area of metal surface, the pulsed beam is moved through multiple adjacent passes that overlap each other sufficiently to have the treatment area, including the edges, completely covered by the rapidly heated and quenched metal. Generally, the laser heat spot diameter, a localized portion of the metal surface, is about about 0.25 to 1.3 mm, e.g., a briefly molten pool of about 1.27 mm diameter. Where the surface is traversed by laser melting, the melted-and-quench solidified path may be referred to as a "bead", although without placement of a conventional weld metal bead. Travel speed can be up to 1.52 meters per minutes (m/min), advantageously about 1.27 m/min, sometimes 0.76 m/min or lower. Variables such as travel speeds, operating power, pulse rate and on/off ratio are controlled in correlation that is effective for accomplishing the rapid heating and quenching at the surface of the body being treated. In most articles for treatment the body mass is a sufficient heat sink for chilling the surface when the beam leaves the heat spot.

While travel speed is sometimes referred to as movement of the laser beam when the workpiece metal is stationary, it is understood that the process functions with movement of beam or metal, or both, in relation to each other and either one can be held stationary and the other moved. Movement whereby the beam is separated from the specific location of the heated metal results in cessation of the heating and subsequent cooling.

Referring now to the photomicrographic figures on the accompanying drawing:

FIG. 1 shows continuous solid solution bands of austenitic stainless steel in the cross-section of overlapping melted and chilled laser beads and also shows, in the base metal, highly visible grain boundaries extending up to approximately one-third of a grain diameter from the fusion zone; and FIG. 2 shows resolution of carbide particles near to, and yet distinctly away from, the fusion zone and the absence of any continuous carbide phase within the fusion zone.

For purposes of giving those skilled in the art a further understanding of the invention and advantages thereof, the following example is described.

A 350 watt beam from a pulsed Nd (neodymium) doped laser beam (wavelength 1.06 μm) was applied to surface treat four rectangular specimens of AISI Type 304 stainless steel (18–20% Cr, 8–12% Ni) with multiple overlapping linear passes that traveled over the central portion (about two-thirds of the length) of the surface and both side edges of one major face of each specimen according to the following particulars:

Dimensions of the specimens were 82.6 mm×12.7 mm×3.2 mm;

Number of linear passes per specimen was about 25;

Chemical composition of the steel comprised 8.6% nickel, 19.1% chromium, 0.045% carbon, 0.3% molybdenum, 1.6% manganese, 0.1% silicon and 0.3% copper with the balance being iron;

Heat treatment before laser treatment was 1 h/1121° C./WQ+2 h677° C./AC (1 hour at 1121° C. followed by water quenching, plus 2 hour at 677° C. followed by air cooling to room temperature);

Travel speed of laser beam was about 2 cm/sec;

Pulse rate was 200 pps; and

Pulse power time was 1 msec (millisecond).

The laser beam was applied directly onto clean metal surfaces of the specimens. During travel of the beam the surface metal was rapidly heated to the molten state and cooled back to the solid state. An area of about 7.1 $cm^2$ on each specimen was thus treated. Heating and quenching rates in this example of the process are understood as being about $1.6\times10^6$ °C. per second. After the treatment the metal surface appeared satisfactorily clean and smooth and free of cracking. Each of the four laser-treated specimens were bent and loaded in accordance with standard ASTM G30-79 (making and using U-bend stress corrosion test specimens.) with the laser-treated surface on the outer, most highly stressed, curve of the bend. Bolts of nominal Type 304 stainless steel composition were used to maintain the stress. The four specimens were exposed in boiling aqueous pH 2 hydrochloric acid solutions containing 26 wt % NaCl (sodium chloride). All four of the laser-treated U-bend specimens satisfactorily survived the 72 hours of test exposure in the solution and, when examined with a binocular microscope at 10-80X magnification after the expsoure, were found free of cracking.

In contrast, and differently from the invention, four other U-bend specimens of the same Type 304 stainless steel but which were not laser-treated were found to be severely cracked after exposure in the same strength boiling aqueous acid and chloride solution for the same exposure time. Heat treatments of the non-laser treated specimens, before exposure were: 1 h/1121° C./WQ (two specimens) and 1 h/1121° C./WQ plus 2 h/677° C./AC (two specimens).

In other examples, laser treated areas of unstressed specimens of Type 304 stainless steel that were furnace heat treated and then laser treated according to the treatments of the foregoing stress-corrosion example (of preparation for U-bend testing) showed superior resistance to pitting corrosion, in comparison to non-laser treated specimens when subjected to the standard ASTM G48-76 aqueous ferric chloride pitting test at both 35° C. and 50° C. for 24 hours.

The present invention is particularly applicable to improving the corrosion resistance of stainless steels, such as Type 304, at the surfaces of many various articles, e.g., valves, flanges, compression joints, fittings and others, and also is especially beneficial for improving corrosion resistance of weldment surfaces and weld affected areas, particularly including heat affected zones resulting from welding. Moreover, the invention is considered applicable for overcoming crevice corrosion possibilities at confined areas, such as flange connections and fasteners, and areas subject to barnacle attachment.

It is to be appreciated that modifications and variations of the process and apparatus described herein will be obvious from the light of the present specification and drawing and may be practiced without materially departing from the essence of the present invention and the scope of the following claims.

We claim:

1. A process for enhancing the corrosion resistance of stainless steel comprising directing a pulsed energy beam onto a localized portion of a metal surface of stainless steel to rapidly heat the metal to at least the solid solution temperature and then chilling the thus heated metal to result in a quench rate of at least $1\times10^3$ °C. per second whereby the thus treated localized portion of the surface exhibits enhanced resistance to corrosion.

2. A process as set forth in claim 1 wherein the metal is heated to at least the melting temperature.

3. A process as set forth in claim 1 wherein the chill rate is at least $1\times10^5$ °C. per second.

4. A process as set forth in claim 1 wherein a pulsed laser is employed and the average operating power of the laser is at least 50 W.

5. A process as set forth in claim 1 wherein the stainless steel is of the composition known as Type 304.

6. A process as set forth in claim 1 wherein the localized portion that is heated is of about 0.254 to 1.27 mm average diameter.

7. A process as set forth in claim 1 wherein the pulse rate is 100 to 200 pulses per second.

8. A process as set forth in claim 1 wherein the laser wavelength is 0.5 to 11 microns.

9. A process as set forth in claim 1 wherein the chill rate is about $1\times10^6$ to $1\times10^8$ °C. per second.

10. A process as set forth in claim 1 wherein the travel speed of the beam relative to the metal is about 30 to 60 inches per minute.

* * * * *